United States Patent [19]

Bippus

[11] 4,222,294

[45] Sep. 16, 1980

[54] FASTENER TOOL SOCKET RETAINING ASSEMBLY

[75] Inventor: Jacob R. Bippus, Pittsburgh, Pa.

[73] Assignee: Rockwell International Corporation, Pittsburgh, Pa.

[21] Appl. No.: 970,120

[22] Filed: Dec. 18, 1978

[51] Int. Cl.[3] ..... B25B 13/00

[52] U.S. Cl. ..... 81/177 R; 81/55

[58] Field of Search ..... 81/55, 56, 177 R, 177 A, 81/177 G; 403/328, 108

[56] References Cited

U.S. PATENT DOCUMENTS

| | | | |
|---|---|---|---|
| 2,474,360 | 6/1949 | Jimerson | 403/328 |
| 3,118,696 | 1/1964 | Resave | 81/177.6 |
| 3,394,623 | 7/1968 | Kinakin | 81/55 |
| 3,397,601 | 8/1968 | Batten | 81/56 |
| 3,584,527 | 6/1971 | Bosten | 81/56 |

FOREIGN PATENT DOCUMENTS

| | | | |
|---|---|---|---|
| 1293866 | 10/1972 | United Kingdom | 81/55 |

*Primary Examiner*—James L. Jones, Jr.

[57] ABSTRACT

A tool having a rotatable axially bored drive shaft for manipulating a fastener, such as a nut or bolt, is provided with retainer means for holding a removable, fastener-gripping socket in position on the shaft end while permitting an auxiliary non-rotatable tool shank to project through the axial bore and out the shaft end. The retainer means preferably comprises a circular steel spring structure fitted in the axial bore which urges a depressible socket-engaging button to project a short distance outwardly on a side surface of the shaft adjacent its end.

2 Claims, 4 Drawing Figures

Fig. 1.
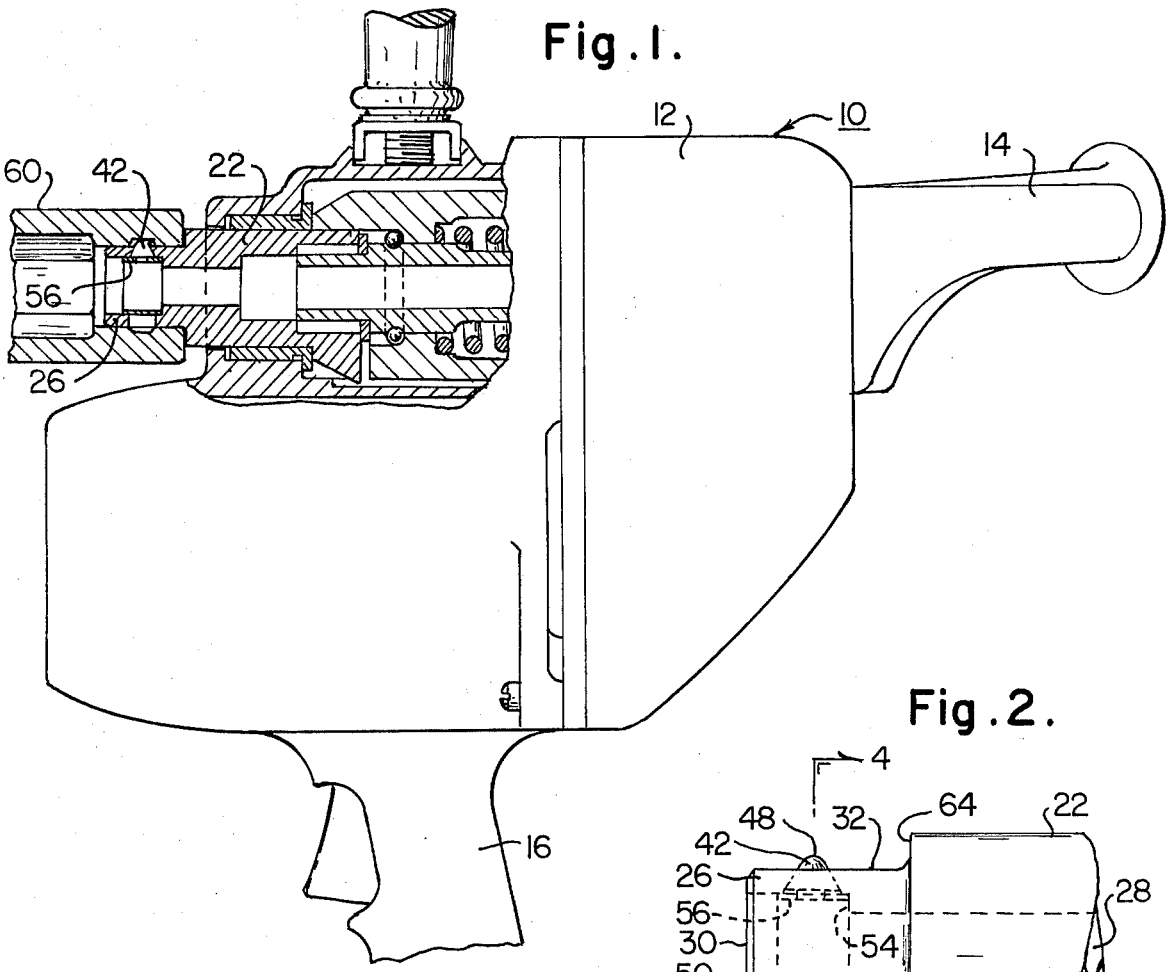
Fig. 2.
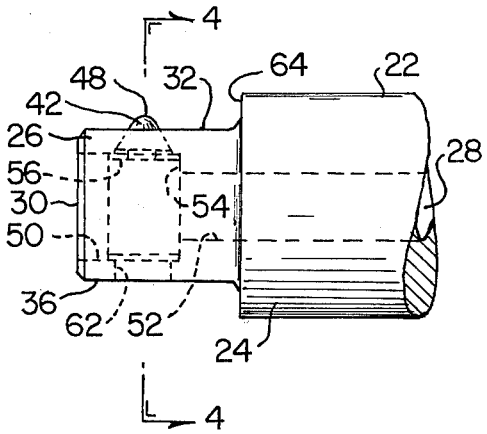
Fig. 3.
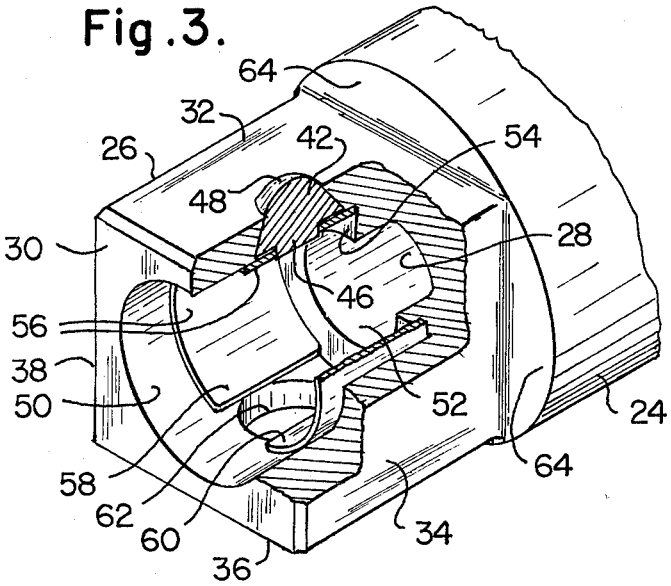
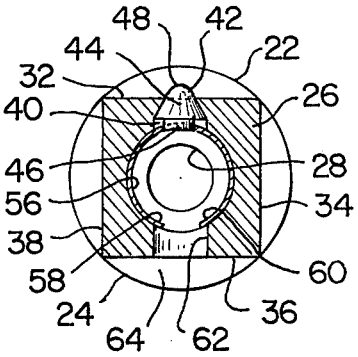
Fig. 4.

FASTENER TOOL SOCKET RETAINING ASSEMBLY

BACKGROUND OF THE INVENTION

1. Field of the Invention:

This invention relates generally to fastener driving tools and more particularly pertains to a tool adapted to removably receive on the drive end of its rotatable shaft a drive socket for engaging and manipulating pairs of fasteners, such as nuts and bolts, wherein the tool's shaft has an axial bore opening on the face of its drive end permitting a non-rotatable auxiliary tool shank to extend through the shaft outward from the shaft's drive end. The auxiliary tool shank serves the purpose of engaging and preventing rotation of a first fastener of a pair of fasteners to be joined or separated while the second fastener of the pair is rotatably driven relative to the first.

2. Description of the Prior Art:

In the prior art there are various types of wrenches manually operated or motor driven, utilizing a rotatable shaft which is driven to impart rotative motion to a socket engaged on a bolt head or a nut. Such sockets are available in various standard sizes for selected utilization with different size fasteners, and generally have square rear hole or opening to enable fitting the socket onto the drive end of the rotatable shaft of the wrench being utilized. The drive end of the shaft is square in cross section and of a size to be inserted into the square hole of the socket, forming a driving engagement therewith.

A socket driving tool may alternatively be provided with a drive end other than the familiar type which is square in cross section, such as a five-sided or hexagonal drive end or a spline configuration. Sockets for these alternative drive end configurations are, of course, adapted inwardly with an accommodating mating configuration to enable manual installation and removal of the socket onto the drive end. It is contemplated that the invention described herein may be utilized on various drive end configurations, although the preferred embodiment herein described and illustrated is of the square-end type.

Various means have been heretofore provided, on the drive end of such a wrench shaft, to cause a tight gripping action between the drive end and the internal surface of the rear end portion of the socket so that the socket will not, slide from its mounted position on the drive end until it is purposely manually disengaged therefrom by pulling it away. The common characteristic of such engagement means for holding a socket on a shaft drive end is the use of a biasing or spring means carried on the drive end which is adapted to have a part thereof depressed inwardly as a function of the socket being slid to its operative position on the drive end whereby outward holding pressure is exerted against the inside surface of the socket, usually in cooperation with an internal annular groove or detent provided on the inside socket surface.

One form of such engaging means is achieved by providing an annular groove near the end of the shaft drive end in which resides a circular inwardly depressible wire spring. The act of inserting the socket onto the drive end causes the wire spring to depress momentarily inwardly until the socket is in its fully installed position on the drive end whereupon the circular spring extends outwardly to engage an annular groove inside the socket to prevent the socket from slipping away from its installed position. Purposeful manual removal of the socket will cause the circular spring to depress inwardly into the groove onto the shaft drive end as the rear portion of the socket passes thereover. This type of engaging means is taught in U.S. Pat. No. 1,469,589 where a spring metal ring, carried in an annular groove, is provided on a bar-like manual socket wrench which is hexagonal in cross section. Similarly, U.S. Pat. Nos. 2,704,681 and 3,752,514 disclose the provision of circular spring means at the outer end of a drive shaft of an impact wrench where the drive end is square in cross section. This type of socket engagement arrangement is advantageous on an impact wrench or any other type of wrench wherein the drive shaft is subject to extreme shock during use, since the drive end is solid and has no openings crossing through its axis which would tend to weaken it and thereby shorten its life.

Another form of engagement means which is commonly utilized at the present time in hand-manipulated socket wrenches is the provision, on a square drive end of a drive shaft, of a depressible hemispheric button or ball detent which projects slightly above one side surface of the drive end. An internal cross bore in the drive end beneath the button houses a spring which urges the button to its normal projecting position, and the button is depressed inwardly as a function of the socket being slid into its operative position on the shaft drive. When the socket reaches its operative position, the button pops outwardly into a groove inside the socket to thereby grip the socket.

At least one prior art patent teaches the use in combination of the encircling ring concept and the depressible button concept. In U.S. Pat. No. 3,752,514, this arrangement may be found wherein a button is normally pushed to its outward projecting position by rearwardly-extending legs of an encircling front-mounted spring ring.

While socket engagement arrangements as heretofore described are unquestionably useful in certain applications, they also have inherent disadvantages in certain specific applications. Where it is desired to have an axial bore through the rotatable drive shaft of a wrench, to accommodate an auxiliary tool extending therethrough, as provided in such U.S. Pat. Nos. as 3,323,394, 3,323,395 and 3,696,693, the use of an annular groove and/or a cross bore in the shaft drive end to accommodate a spring means may be impossible or highly impractical. More specifically, where an axial center bore is provided in a shaft drive end of predetermined outside dimensions, the provision therewith of an annular groove about the drive end can significantly weaken the drive end in the area of the annular groove or cause sufficient reduction of the diameter of the axial bore that it cannot accommodate the extension of an auxiliary tool, such as a screw driver shank therethrough, as taught, for example, in the aforementioned U.S. Pat. No. 3,323,394. Obviously, a laterally directed cross-bore housing a spring for a depressible button would be unacceptable in such a tool because it would intersect the axial bore.

SUMMARY OF THE INVENTION

This invention comprehends the provision of a spring device or retaining means in combination with the drive end of the rotatable shaft of a fastener driving wrench or tool which utilizes interchangeable fastener driving sockets on the drive end for engaging the fastener being driven. Specifically it is a primary objective of this invention to provide a socket retaining means on a rotatable shaft drive end which retains the general function and desirable features of prior art devices, such as heretofore described, but also enables the provision of an axial bore in the drive shaft to accommodate an auxiliary tool without materially weakening the shaft in the area thereof where high torque shock normally occurs.

In view of the dimensional constraints associated with the drive end of the rotatable shaft of the typical fastener driving wrench, strength and structural integrity of the shaft is difficult to maintain where a central or axial bore is provided through the shaft and the drive end is otherwise modified by provision of a transverse cross-bore or outer front end annular groove to accommodate a spring retention means for holding a socket on the drive end. Accordingly, the general function of known retaining means is retained in the present invention but with a structure where shaft strength is retained even though the shaft is provided with a central bore to accommodate an auxiliary tool extending therethrough. Other specific characteristics and advantages of the present invention will be apparent from the ensuing detailed description.

BRIEF DESCRIPTION OF THE DRAWINGS

FIG. 1 is a partially cutaway side view of a power tool constructed in accordance with the principles of the present invention;

FIG. 2 is an enlarged view of part of the rotatable drive shaft of the tool in FIG. 1;

FIG. 3 is a perspective fragmentary view of the structure shown in FIG. 2; and FIG. 4 is a view in vertical section taken along line 4—4 of FIG. 2, but in reduced scale as compared to FIG. 3.

DESCRIPTION OF THE PREFERRED EMBODIMENT

FIG. 1 shows a power tool constructed in accordance with the principles of the present invention and designed to drive a threaded fastener such as a nut onto or off of another threaded fastener such as a bolt while restraining the bolt against rotation. Such restraint is accomplished by using a non-rotating shank extending through the shaft and the socket, which engages a slot or recessed socket in the end of the bolt on which the nut is being driven or removed. The tool 10 is illustrated as comprising a housing 12 having a rearward "D" type handle 14, a pistol-grip handle 16 and a rotatable drive shaft 22 which is driven by a reversible motor and gearing arrangement (not shown) within the housing 12. Details of the motor and drive train arrangement for the tool 10 (not critical to this invention) may be had by reference to U.S. Pat. No. 3,696,693.

The rotatable shaft 22 is illustrated, in FIG. 2 as having a main cylindrical body portion 24 and a forward nose portion or drive end 26 of square cross section. As shown in FIG. 3, the entire shaft 22 is provided with an axial bore 28 opening on the face or end surface 30 of the drive end 26. The bore 28 is to accommodate therethrough an auxiliary tool, which may be in the form of a separate tool shank (not shown) having an end extending beyond the drive end 26 for engaging a fastener, as described in more detail in the aforementioned U.S. Pat. No. 3,696,693. Such auxiliary tool extending through the bore 28 serves to hold a bolt in stationary position while a socket carried on the drive end 26 rotates a nut on or off the bolt as desired.

In addition to its end surface 30 the drive end 26 has four side surfaces 32, 34, 36 and 38 in four respective planes as shown in FIG. 4, surface 32 has a hole 40 extending therethrough to the central bore 28 in which is installed a depressible button 42. The button 42 has a domed-shaped major body portion 44, as shown in FIG. 4, and a downwardly projecting integral cylindrical boss 46. The hole 40 is shaped complimentary to the dome 44 whereby only its upper hemispheric end 48 projects above the surface 32.

The axial bore 28 in the shaft 22 comprises a substantially wide bore section 50 adjacent the face end 30 and a narrower rear bore portion 52, as shown in FIG. 2. The sections 50 and 52 merge at a shoulder 54, and carried forward of the shoulder 54 within the section 50 is a ringlike biasing means in the form of a steel spring 56.

As shown in FIGS. 3 and 4, the spring 56 is split in its lower portion whereby two legs, 58 and 60 are spaced apart adjacent an opening 62 extending from the bore section 50 to the side surface 36. The spring member 56 resides in the section 50 against the shoulder 54 in a circumferentially recessed disposition relative to the section 52 whereby a tool shank extending through the shaft 22 and outwardly through the drive end 26 is surrounded by, but slightly circumferentially spaced from, the ring-member 56.

Installation of a socket onto the drive end 26 will cause the button 42 to depress inwardly as a function of its contact with the inside surface of the socket. Inward movement of the button 42 will cause spring member 56 to move slightly downwardly whereby its legs 58 and 60 will tend to move toward each other and close the space therebetween until the socket is in position whereby the button 42 can move upwardly into the inside annular groove provided in the socket for such purpose and the member 56 can assume its original shape and position.

It should be noted that oppositely disposed holes 62 and 40, as shown in FIG. 2 are on a common center line well forward the shoulder 54 whereby the portion of the drive end 26, from the shoulder 54 rearwardly to an outside shoulder 64 has a thicker circumferential sidewall portion than the section 50 providing a relatively thick sidewall section in the area where torque forces on the socket will be transferred to the shaft. Torque stress transmitted through the socket 60 (FIG. 1) to the drive end 26 does not occur to the forwardly located thinner circumferential side wall of section 50 where holes 40 and 62 are disposed.

Hole 62 serves a dual purpose, enabling extension of a drilling tool through hole 62 to form the proper inside contour of the hole 40 and the presence of the hole 62 also facilitates installation and removal of the spring member 56 and button 42 from its installed position within the drive end 26.

While a presently preferred form of the invention has been heretofore described and shown, certain equivalent variations may occur to those skilled in the art in light of the above teachings. It should be understood that the appended claims are intended to cover within their spirit and scope all such variations.

I claim:

1. A socket driving tool for use in rotatably manipulating a fastener such as a nut or bolt comprising a rotatable shaft with a drive end adapted to have a socket removably secured thereon, the drive end being formed for driving engagement with a complimentary shaped surface of an open-ended drive socket, an axial bore through the shaft which opens on the end surface to accommodate the extension therethrough of a non-rotatable tool shank, a hole extending through the side wall of the axial bore, inwardly depressible detent means projecting outwardly from the hole to retain the socket on the drive end and annular biasing means for said detent means within said bore and adapted to permit the extension of the tool shank through the axial bore while acting to urge the detent means to its outwardly projecting position.

2. The socket-driving tool of claim 1 wherein said hole extending through the side wall is a tapered hole with the smaller diameter of the taper at the exterior of the side wall for retaining said detent means in position.

* * * * *